US009945530B2

(12) United States Patent
Hager et al.

(10) Patent No.: US 9,945,530 B2
(45) Date of Patent: Apr. 17, 2018

(54) GENERATING A LIGHT EMISSION PATTERN IN A FAR FIELD

(71) Applicant: OSRAM GmbH, Munich (DE)

(72) Inventors: Jürgen Hager, Herbrechtingen (DE); Stephan Schwaiger, Ulm (DE)

(73) Assignee: OSRAM GmbH, Munich (DE)

( * ) Notice: Subject to any disclaimer, the term of this patent is extended or adjusted under 35 U.S.C. 154(b) by 0 days.

(21) Appl. No.: 15/309,473

(22) PCT Filed: Apr. 29, 2015

(86) PCT No.: PCT/EP2015/059349

§ 371 (c)(1),
(2) Date: Nov. 8, 2016

(87) PCT Pub. No.: WO2015/169665

PCT Pub. Date: Nov. 12, 2015

(65) Prior Publication Data

US 2017/0138556 A1 May 18, 2017

(30) Foreign Application Priority Data

May 8, 2014 (DE) ..... 10 2014 208 660

(51) Int. Cl.
*F21S 8/10* (2006.01)
*F21K 9/64* (2016.01)

(52) U.S. Cl.
CPC ..... *F21S 48/1773* (2013.01); *F21K 9/64* (2016.08); *F21S 48/1159* (2013.01); *F21S 48/14* (2013.01); *F21S 48/1789* (2013.01)

(58) Field of Classification Search
CPC .... F21S 48/1773; F21S 48/14; F21S 48/1159; F21S 48/1789

(Continued)

(56) References Cited

U.S. PATENT DOCUMENTS 9,074,755 B2 7/2015 Finsterbusch et al.
2009/0103293 A1 4/2009 Gerard et al.
(Continued)

FOREIGN PATENT DOCUMENTS

DE 102007037875 A1 2/2009
DE 102010062460 A1 6/2012
(Continued)

OTHER PUBLICATIONS

German Search Report based on application No. 10 2014 208 660.4 (8 pages) dated Feb. 24, 2015 (for reference purpose only).
(Continued)

*Primary Examiner* — Laura Tso
(74) *Attorney, Agent, or Firm* — Viering, Jentschura & Partner mbB

(57) ABSTRACT

Various embodiments may relate to a lighting apparatus for a headlight for generating a light emission pattern in a far field, including at least one light source for emitting primary light onto an illumination surface, at least two different phosphor surfaces which are introducible into the illumination surface, at least partly alternately by at least one translational movement, and a control device for positioning the phosphor surfaces in relation to the illumination surface. A respectively associated light emission pattern is generatable in a predetermined position of the phosphor surfaces. The control device is configured, for the purpose of setting a specific light emission pattern, to move at least one phosphor surface provided for this purpose into the illumination surface by at least one translational movement.

14 Claims, 4 Drawing Sheets

(58) Field of Classification Search
USPC ..... 362/510
See application file for complete search history.

(56) References Cited

U.S. PATENT DOCUMENTS

| | | | | |
|---|---|---|---|---|
| 2011/0116253 | A1* | 5/2011 | Sugiyama | F21S 10/007 362/84 |
| 2011/0249460 | A1* | 10/2011 | Kushimoto | B60Q 1/085 362/510 |
| 2013/0271947 | A1* | 10/2013 | Finsterbusch | F21S 48/114 362/19 |
| 2013/0301237 | A1* | 11/2013 | Finsterbusch | G03B 21/204 362/84 |
| 2014/0029282 | A1 | 1/2014 | Ravier et al. | |
| 2014/0185272 | A1* | 7/2014 | Kishimoto | F21V 29/02 362/84 |
| 2015/0049457 | A1 | 2/2015 | Kroell | |
| 2015/0103546 | A1* | 4/2015 | Langkabel | F21S 48/1145 362/510 |
| 2015/0176792 | A1* | 6/2015 | Hager | F21S 48/1131 362/510 |
| 2015/0211705 | A1* | 7/2015 | Leitow | F21S 48/1225 362/510 |

FOREIGN PATENT DOCUMENTS

| | | | |
|---|---|---|---|
| DE | 102010062465 | A1 | 6/2012 |
| DE | 102012004629 | A1 | 10/2012 |
| DE | 102012203442 | A1 | 9/2013 |
| EP | 2063170 | A2 | 5/2009 |
| EP | 2602536 | A1 | 6/2013 |
| EP | 2690352 | A1 | 1/2014 |
| WO | 2007141688 | A1 | 12/2007 |
| WO | 2013164276 | A1 | 11/2013 |

OTHER PUBLICATIONS

International Search Report based on application No. PCT/EP2015/059349 (5 pages + 3 pages English translation) dated Jul. 6, 2015 (for reference purpose).

* cited by examiner

GENERATING A LIGHT EMISSION PATTERN IN A FAR FIELD

RELATED APPLICATIONS

The present application is a national stage entry according to 35 U.S.C. § 371 of PCT application No.: PCT/EP2015/059349 filed on Apr. 29, 2015, which claims priority from German application No.: 10 2014 208 660.4 filed on May 8, 2014, and is incorporated herein by reference in its entirety.

TECHNICAL FIELD

Various embodiments relate generally to a lighting apparatus for a headlight for generating a light emission pattern in a far field, including at least one phosphor surface and at least one light source which is spaced apart from the phosphor surface and serves for emitting primary light for illuminating the phosphor surface, as a result of which an associated light emission pattern is generatable. Various embodiments are applicable in particular to a vehicle headlight, in particular for an automobile or truck.

BACKGROUND

WO 2011/160680 A1 discloses a light source arrangement including a primary light source and a secondary light source, wherein the primary light source is configured to illuminate the secondary light source, wherein the secondary light source includes a polyhedron having at least one first and one second phosphor surface, wherein the primary light source includes at least one laser or one light emitting diode, and wherein a drive mechanism is fixed to the primary light source or to the secondary light source.

US 2006/0227087 A1 discloses laser display systems which generate at least one scanning laser beam in order to generate one or more luminescent materials on a screen that emits light in order to form images. The luminescent materials may include phosphor materials.

EP 2 359 605 B1 discloses an illuminant including at least one semiconductor laser which is configured to emit a primary radiation having a wavelength of between 360 nm and 485 nm inclusive, and at least one conversion means which is disposed downstream of the semiconductor laser and is configured to convert at least part of the primary radiation into a secondary radiation having a longer wavelength different than that of the primary radiation, wherein the radiation emitted by the illuminant has an optical coherence length that is at most 50 micrometers, wherein the conversion means has a concentration of color centers or luminous points that amounts to at least $10^7/\mu m^3$, and the color centers or luminous points are statistically distributed in the conversion means, and wherein a focal spot of the conversion means that is irradiated by the primary radiation has an area of at most 0.5 square millimeter.

SUMMARY

Various embodiments provide an improved possibility for diversely setting a light emission pattern by a "remote phosphor" apparatus.

Various embodiments provide a lighting apparatus for a headlight for generating a light emission pattern, including at least one light source for emitting primary light onto an illumination surface; at least two different phosphor surfaces which are introducible into the illumination surface at least partly alternately by at least one translational movement; and a control device for positioning the phosphor surfaces in relation to the illumination surface; wherein a respectively associated light emission pattern is generatable in a predetermined position of the phosphor surfaces; and the control device is configured, for the purpose of setting a specific light emission pattern, to move at least one phosphor surface provided for this purpose into the illumination surface by at least one translational movement.

This lighting apparatus has the advantage that it is possible to switch over between different light emission patterns with comparatively low structural outlay.

The fact that the phosphor surfaces are introducible into the illumination surface encompasses the fact that the phosphor surfaces are arranged at a distance from the at least one light source. This corresponds to a "remote phosphor" arrangement.

The far field may be in particular a field or space at a distance of from at least two meters up to a distance of hundreds of meters in front of the headlight.

The illumination surface may correspond in terms of size and extent and form factor, in particular, to a luminous spot generated by the primary light.

A phosphor surface includes at least one phosphor or conversion substance (colorant) which converts the primary light incident thereon at least partly into secondary light having a different wavelength, in particular a longer wavelength. This wavelength conversion is known in principle, and need not be explained further here. By way of example, a phosphor may convert incident blue primary light partly into yellow secondary light, such that blue-yellow or white mixed light having corresponding proportions of primary light and secondary light is emitted overall by the phosphor surface. In principle, however, a full conversion is also possible.

The fact that phosphor surfaces are different may encompass the fact, in particular, that they have a different shape, a different type of phosphor(s) and/or a different phosphor distribution. The different phosphor distribution may encompass a different concentration of the phosphor and/or a different thickness of the phosphor surface. The different type of phosphor may encompass completely different phosphors (e.g. phosphor A in one phosphor surface and phosphor B in another phosphor surface) or partly different phosphors (e.g. phosphor A in one phosphor surface and phosphors A and B in another phosphor surface). Different phosphor surfaces bring about correspondingly different light emission patterns when they are irradiated with primary light. In this regard, for generating a light emission pattern having an inhomogeneous color distribution, at least one associated phosphor surface may be covered inhomogeneously with at least one phosphor, e.g. with an inhomogeneous layer thickness and/or an inhomogeneous phosphor concentration of at least one phosphor, in particular over a large area. By changing a light color of the light emission pattern by a different phosphor distribution of two alternately illuminatable phosphor surfaces, it is possible in turn for specific boundary conditions of the vehicle and/or of the driver to be taken into account better. In this regard, the light color can be adapted for example to the presence of fog or rain, but e.g. also to a combination of fog or rain with an old or young driver. The characteristics of persons who are color blind or partly color blind (e.g. with a red/green deficiency) can now be taken into account as well. It is possible in turn to achieve greater traffic safety as a result. Additional convenience for the driver or the occupants can also be produced.

At least one phosphor surface may have a uniform distribution of phosphor. This enables a uniformly illuminating light emission pattern.

Additionally or alternatively, at least one phosphor surface may have a nonuniform distribution of at least one phosphor. This enables a light emission pattern that is diverse with regard to a brightness and/or a light color, for example, in a particularly simple manner.

In particular, at least one phosphor surface may include a plurality of phosphors which are distributed over the phosphor surface nonuniformly with respect to one another. As a result, multicolored light emission patterns can be provided in a particularly simple manner. If a partial region of the phosphor surface includes partial regions in which a plurality of phosphors are present, a light emission pattern having partial regions merging into one another in terms of color can be generated in a simple manner. However, a phosphor surface may also include mutually separate partial regions having different phosphor concentrations and/or phosphors or phosphor mixtures. Supplementarily or alternatively, the partial regions having different phosphor concentrations may adjoin one another and fill at least one partial region of the illumination surface in a continuous fashion. For this purpose, for example, partial regions with a sixfold-polygonal structure and/or as a combination of different geometrical shapes are provided, specifically in particular in the sense of a continuous "tessellation" (e.g. a so-called "Penrose tessellation").

The phosphor surfaces are arranged in particular on at least one at least translationally displaceable carrier. This affords the advantage that a position of the phosphor surfaces is variable in a mechanically simple manner, namely by a displacement of the at least one carrier. In particular, a specific translational position of the carrier may correspond to an associated light emission pattern.

The phosphor surfaces may be arranged for example in a layer-like fashion or as a layer or layer system on the carrier. The carrier may have a plate- or sheet-like basic form. For effective dissipation of heat from the phosphor, the carrier preferably consists of a material having good conductivity, e.g. of metal or sapphire. The carrier may be cooled.

In one development, white or whitish light, in particular mixed light generated by only partial conversion, can be emitted by each phosphor surface. As a result, phosphor surfaces can be excluded, in particular, in which the mixed light is generated only downstream of the phosphor surface by superimposition, e.g. by virtue of radiation of different colors that is generated by the phosphor surface combining downstream of or after the phosphor surface. By way of example, phosphor surfaces can thus be excluded which have regions which are arranged closely alongside one another (closely localized) and include different phosphors (grouped e.g. in strip form or as pixels), wherein the phosphors generate secondary light with respective color proportions of the mixed light. Therefore, it is possible to exclude, in particular, strips or pixels including phosphors that generate primary colors, e.g. the primary colors red, green and/or blue (RGB color space) or cyan, magenta and/or yellow (CMY color space).

However, a use of two phosphors having different colors of the secondary light generated by them is likewise conceivable in principle, e.g. for a change between a daytime running light or a sidelight having a white color and a flashing indicator function (e.g. for a change-of-direction indicator) having a yellow color.

In one development, the light reflected or backscattered from the phosphor surface is used as useful light for generating the light emission pattern in the far field ("reflective arrangement"). This may mean, in particular, that this light of the phosphor surface is reflected in a targeted manner (e.g. by fitting on a reflective carrier). Alternatively or additionally, the light emerging at that side of the phosphor surface which faces away from the incident primary light may be used as useful light for generating a light emission pattern in the far field ("transmitted-light arrangement" or "transmissive arrangement"). The at least one light source is fundamentally unrestricted in terms of its type. For particularly effective wavelength conversion, a light source having a narrow spectral band is preferred, such as, for example, semiconductor light sources, e.g. a light emitting diode (LED) or in particular a laser diode. In one development, at least one light source is a semiconductor light source. In one variant, the at least one semiconductor light source includes at least one light emitting diode. The at least one light emitting diode can itself contain at least one wavelength-converting phosphor (conversion LED). The at least one light emitting diode can be present in the form of at least one packaged light emitting diode or in the form of at least one LED chip. A plurality of LED chips can be mounted on a common substrate ("submount"). Instead of or in addition to inorganic light emitting diodes, e.g. on the basis of InGaN or AlInGaP, generally organic LEDs (OLEDs, e.g. polymer OLEDs) can also be used. Alternatively, the at least one semiconductor light source can include or be e.g. at least one diode laser. The at least one semiconductor light source can be equipped with at least one dedicated and/or common optical unit for beam guiding, e.g. at least one Fresnel lens, collimator, and so on.

The primary light generated by at least one light source may be split into two or more different light beams, e.g. by a beam splitter. The light of a plurality of light sources may alternatively or additionally be combined or united in one light beam.

The control device may be coupled to at least one motor for moving the phosphor surfaces or may include at least one such motor. The at least one motor may displace translationally, in particular linearly, in particular at least one carrier for the phosphor surfaces. The control device may be an electronic unit.

The control device may be a part of a lighting apparatus that can be installed as a module in the vehicle, or may be provided in the vehicle and, after the installation of a lighting apparatus, may be connected thereto, in particular to a motor of the lighting apparatus.

In one development, at least two phosphor surfaces are arranged at a distance from one another, e.g. separated by a gap or an edge or a corner. In another development, at least two phosphor surfaces are arranged in a manner directly adjoining one another, e.g. are arranged adjacently practically without any gaps or are formed as partial regions of a larger (multiple or group) phosphor surface formed in a continuous fashion.

The shape of a phosphor surface is unrestricted and may be at least partly planar or curved. The phosphor surface may be shaped in a freeform fashion and have e.g. a plurality of facets. Moreover, phosphor surfaces may project from the basic plane, for example by tilting or inclination.

An optical unit may be disposed upstream of the phosphor surface, said optical unit being concomitantly displaceable or arranged in a positionally fixed manner with respect thereto, for example for beam shaping and/or spectral filtering of a light beam incident on the phosphor surface and/or for beam shaping and/or spectral filtering of a light emitted by the phosphor surface (including a mixed light).

The optical unit may include one or more optical elements, e.g. at least one lens, at least one concentrator, at least one collimator, at least one reflector, at least one diaphragm, at least one filter, etc.

In one development, moreover, an optical unit for directing the light emitted by the at least one phosphor surface into the far field is disposed downstream of at least one currently illuminatable phosphor surface (which is thus situated within the illumination surface). This downstream ("secondary") optical unit is, in particular, not rotationally movable together with the phosphor surfaces and serves for example for beam shaping and/or spectral filtering of the light emitted by the phosphor surface (including a mixed light). The optical unit may include one or more optical elements, e.g. at least one lens, concentrator, collimator, reflector, diaphragm, filter, etc. In the case of illumination of a plurality of phosphor surfaces, the latter may irradiate identical and/or different regions of the downstream optical unit.

In one development, furthermore, the lighting apparatus includes at least one shell-like reflector which is disposed downstream of at least one currently illuminatable phosphor surface. The at least one currently illuminatable phosphor surface is preferably situated in the region of a focal spot of the reflector irradiated thereby.

In particular, at least two light emission patterns may have a differently white light color. In one development thereof, they have an identical shape. In this regard, a light emission pattern may be changed only in terms of color, e.g. for adaptation to changed lighting conditions.

Moreover, it is possible to provide two disjoint (non-overlapping) partial regions of a phosphor surface with different phosphors homogeneously in each case.

In one configuration, at least one phosphor surface is movable into the illumination surface by a pure translational movement (that is to say without a rotation component). The at least one phosphor surface thus maintains its orientation in space. A particularly simple movement can thus be achieved.

A movement path or trajectory of the at least one phosphor surface is arbitrary, in principle, and may thus also be curved. The movement path may lie in a three-dimensional space or in a plane. For a particularly simple movement, the translational movement may be a linear or rectilinear translational movement.

In addition, a rotational movement of the at least one phosphor surface may be superimposed on the translational movement, in particular in order to achieve a pivoting of the phosphor surface. Moreover, an at least one phosphor surface displaced on a curved trajectory or movement path may be used instead of or in addition to a linear translational movement.

In another configuration, at least one phosphor surface is movable into the illumination surface by a translational movement and additionally a rotational movement. This also encompasses a pivoting movement of the at least one phosphor surface. The rotational movement may have a pivot or an axis of rotation within the at least one phosphor surface, within a carrier of the phosphor surface or at a distance therefrom.

However, lighting apparatuses are excluded in which a movement of the at least one phosphor surface, in particular of all the phosphor surfaces, can be described purely by a rotation, in particular about a pivot that is fixed or spatially fixed with respect to the lighting apparatus or about a spatially fixed axis of rotation.

In another configuration, a light emission pattern is generatable by at least one primary light beam aligned in a stationary fashion (that is to say "statically"). This means, in particular, that a light path of at least one primary light beam does not change over time, but rather remains aligned fixedly or in a stationary fashion. In this case, the light emission pattern is generated completely in particular at each point in time. This configuration is implementable in a particularly simple manner. In one development specifically preferred for this configuration, the at least one primary light beam has a significant cross-sectional size. This affords the advantage that the primary light beam can simultaneously illuminate a large region of the at least one phosphor surface that is currently illuminatable in the specific occupied position.

In another configuration, moreover, a light emission pattern is generatable by mean of a movement of at least one primary light beam (that is to say "dynamically"). This enables an—in particular line by line—"scanning" illumination of the phosphor surface in which at least one primary light beam successively illuminates different regions of the at least one phosphor surface. As a result, differently shaped light emission patterns can be generated by an identical phosphor surface situated in an identical position. It is also possible to carry out the movement of the primary light beam non-resonantly, that is to say not to describe lines and columns periodically, but rather to handle the movement of the primary light beam totally freely.

In a further configuration, a plurality of phosphor surfaces (i.e. at least two thereof) are arranged on at least one common, translationally, in particular linearly, displaceable or movable carrier. This affords the advantage that a position of all the phosphor surfaces of the common carrier is variable in a mechanically simple manner, namely by a displacement of said carrier. In particular, a specific translational, in particular linear, position of the carrier may correspond to an associated light emission pattern. This configuration encompasses all the phosphor surfaces being arranged on exactly one common carrier. This configuration also encompasses the phosphor surfaces being arranged on a plurality of carriers, wherein in each case at least two phosphor surfaces are arranged on at least one carrier, in particular on a plurality of carriers.

In yet another configuration, the at least one translationally, in particular linearly, displaceable carrier includes a plurality of carriers which are translationally, in particular linearly, displaceable independently of one another and each have a plurality of phosphor surfaces, wherein a phosphor surface of a respective carrier is in each case introducible simultaneously into the illumination surface. The light emission pattern of the lighting apparatus is thus generatable by an addition of the individual light emission patterns of the phosphor surfaces of the individual carriers that are situated in the illumination surface. A change in the light emission pattern can be achieved by a displacement of one or more of said carriers and thus an exchange of at least one phosphor surface in the illumination surface. This configuration enables a particularly diverse configuration of the light emission pattern in a simple manner. As a result, a light emission pattern can be generated in a particularly compact manner.

The carriers may be carriers that are displaceable parallel to one another, in particular. The carriers may have the same basic form, e.g. a strip-like basic form. The carriers may be arranged in a series adjacently to one another, in particular collinearly.

The simultaneous illumination of the phosphor surfaces of a plurality of carriers can be implemented for example by one or a plurality of primary light beams. The plurality of primary light beams may be generated e.g. by at least one respective light source, alternatively by a common light source and subsequent splitting of the primary light beam into a plurality of partial beams. Very generally, the light emission pattern may be generatable by simultaneous illumination of a plurality of individually translationally, in particular linearly, movable phosphor surfaces.

The headlight may be, in particular, a vehicle headlight. The vehicle may be an aircraft, a water-bound vehicle or a land-bound vehicle. The land-bound vehicle may be a motor vehicle.

The use of the vehicle headlight in a truck or automobile is particularly preferred. By different positions of the at least one phosphor surface, it is possible to generate different automotive light emission patterns, e.g. for generating a low beam, a high beam, a fog light, etc. Alternatively or additionally, it is possible to provide identically shaped light emission patterns having a different light color, e.g. a more bluish daytime running light and a less "blue" position light for use at night.

A configuration of the lighting apparatus as a vehicle headlight or as a part thereof is particularly preferred, wherein the vehicle headlight is configured as an AFS ("Adaptive Frontlighting System") headlight or an ADB ("Adaptive Driving Beam") headlight. A simple change that can be implemented in the light emission pattern (e.g. in the light color or color distribution) as a reaction to external influences is possible by changing the position of at least one luminous surface. Such influences can encompass parameters governed by surroundings, such as a weather situation, a state of a roadway, a time of day, a position of the sun, etc., or driver-specific parameters, such as age, fatigue, degree of experience, etc. Such parameters can be detected by a correspondingly configured sensor system of the vehicle, e.g. a camera, a rain sensor, a distance sensor, etc. It is thus also possible, in particular, in the context of an AFS or ADB system, to cover specific combinations of parameters in the light distribution automatically (in particular without participation of the driver). That is to say the adaptation of the color not only to the presence of fog, for example, but also to the combination of fog with an old or young driver. The characteristics of persons who are color blind or partially color blind (e.g. with a red/green deficiency) can also be taken into account in this way. Greater traffic safety can in turn be achieved as a result. Additional convenience for the driver or the occupants can also be produced.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which:

FIG. 1 shows a lighting apparatus 1, e.g. for a vehicle headlight E. The vehicle headlight E may be installed e.g. in a motor vehicle, e.g. in an automobile, a truck or a motorcycle. The vehicle headlight E generates a light emission pattern L in a far field F around the vehicle, in particular in front of the vehicle.

DETAILED DESCRIPTION

Figure 1:
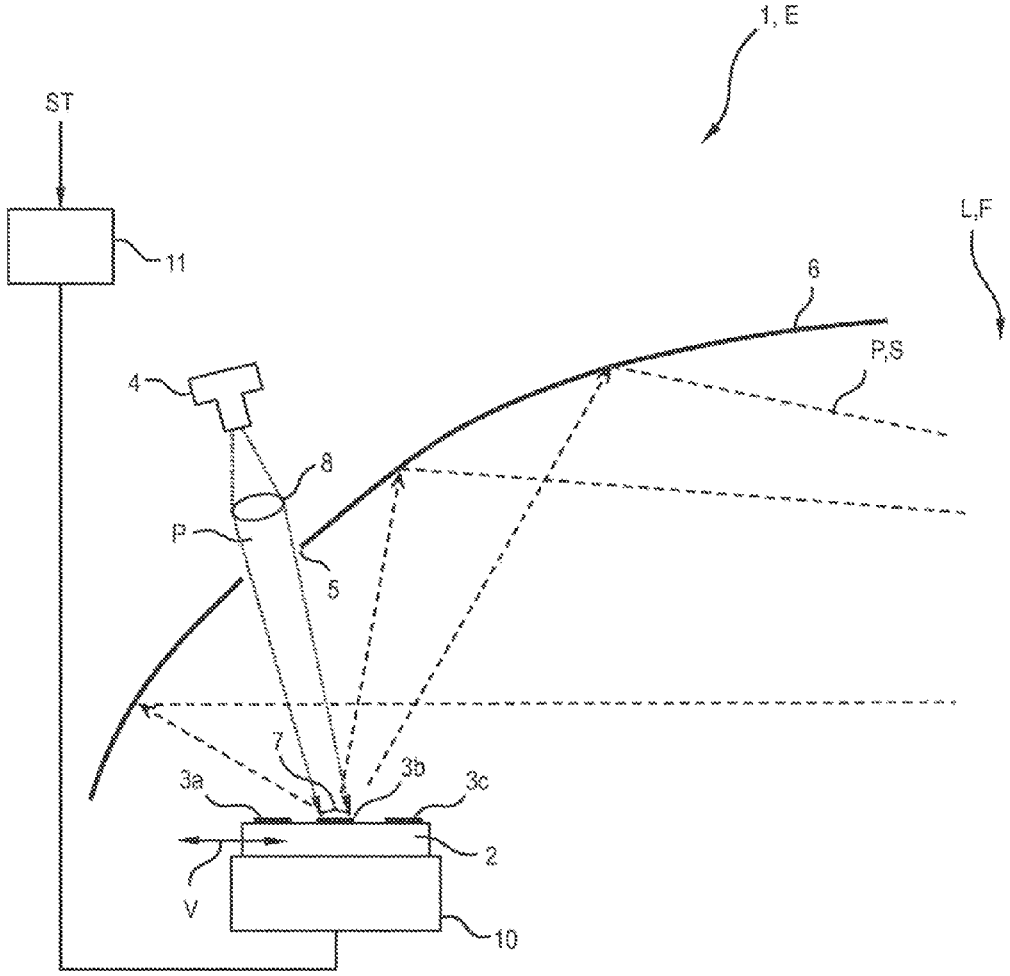
FIG. 1 shows as a sectional illustration in side view a lighting apparatus in accordance with a first embodiment with a linearly displaceable carrier.

The lighting apparatus 1 includes a plate- or sheet-like carrier 2 for three surface-like phosphor volumes, which are designated hereinafter as phosphor surfaces 3*a* to 3*c*. The phosphor surfaces 3*a*, 3*b* and 3*c* bear alongside one another in a series on a planar surface of the carrier 2. The phosphor surfaces 3*a* to 3*c* may have been sprayed or printed onto the carrier 2, for example. Alternatively, the phosphor surfaces 3*a* to 3*c* may have been applied, e.g. adhesively bonded, onto the carrier 2 as respectively prefabricated laminae (e.g. ceramic laminae).

The lighting apparatus 1 furthermore includes a light source in the form of a laser 4, which emits e.g. blue primary light P. The blue primary light P has preferably, but not necessarily, a peak wavelength in the wavelength range of 360 nm to 480 nm, in particular of 400 nm to 460 nm. The laser 4 may include e.g. one or a plurality of laser diodes. The primary light P is radiated through a small window 5 in a shell-shaped reflector 6 obliquely onto the carrier 2, where it can generate an illumination surface 7 corresponding to the luminous spot. Light losses as a result of reflection into the laser 4 are low on account of the window 5 being only small and on account of the oblique incidence.

The beam path of the primary light P remains unchanged over time, that is to say stationary. A temporally unchanging (static) areal provision of the illumination surface 7 is achieved as a result.

An optical unit 8, indicated here by a lens, is interposed between the laser 4 and the illumination surface 7, e.g. for the purpose of beam collimation. Moreover, the primary light P impinging on the illumination surface 7 may be approximately parallelized, instead of being focused as indicated. If a focusing beam path is used, it is also possible, for example, for the phosphor surfaces 3*a* to 3*c* not to be placed at the focus of the beam of the primary light beam P (i.e. in particular also to be positioned downstream of the focus or in the beam that diverges again), in order to be able to set the size of the illumination surface 7 more simply.

In one development, the laser 4 and the optical unit 8 possibly present are situated in a common housing and together form one unit. It is alternatively possible to guide the primary light P via an optical fiber to the carrier 2 or to the phosphor surfaces 3*a*, 3*b* or 3*c* thereof.

The carrier 2 can be displaced along its extended plane by a translational linear movement, here along a displacement direction V. The carrier 2 here assumes different positions in which in each case one of the phosphor surfaces 3*a*, 3*b* or 3*c* lies in the illumination surface 7 or the phosphor surfaces 3*a* to 3*c* are introducible alternately into the illumination surface 7. To put it in yet another way, the carrier 2 can be linearly displaced such that one of the phosphor surfaces 3*a*, 3*b* or 3*c* in each case is illuminatable by the primary light beam P. The phosphor surfaces 3*a* to 3*c* here are each shown as larger than the illumination surface 7. However, this need not necessarily be the case, but affords the advantage that free regions of the carrier 2 are not concomitantly illuminated. The illumination surface 7 can be delimited by a mechanical diaphragm. The latter can be connected to the carrier 2.

The illumination surface 7 preferably has an extent (e.g. of a diameter or an edge length) of at least 20 micrometers. An extent of the illumination surface 7 of 50 μm to 500 μm is particularly preferred. If achieving a high luminance is not of primary importance as the goal, a maximum extent of up to 1000 μm is preferred. These values apply in particular to illumination or irradiation using a laser 4 in the form of a laser diode and an impinging radiation power of 0.25 W to 60 W. For higher laser powers, it is possible to use these extent values with correspondingly higher achievable luminances. With higher laser powers, however, it is also possible to use larger extents, e.g. a doubling of the area defined by the maximum extent in the case of doubling of the laser power, etc.

At the illuminated phosphor surface (shown here as 3*b*) the blue primary light P is converted at least partly into yellow secondary light S. In this case, overall blue-yellow or white mixed light is emitted as useful light P, S by the phosphor surface 3*b*. Depending on the concentration and/or layer thickness of the blue-yellow converting phosphor, the useful light P, S may have a neutral white, a bluish white or a yellowish white color. Preferably, the useful light P, S of each of the phosphor surfaces 3*a* to 3*c* is at least regionally within an ECE color space (that is to say not necessarily white, but for example also yellow, red, etc.).

The phosphor surfaces 3*a* to 3*c* are formed differently, for example with regard to their shape and/or phosphor composition. A phosphor composition may be understood to mean for example presence of one or more specific phosphors, the concentration thereof, the layer thickness thereof and/or the areal distribution thereof or variation of this/these. The phosphor surfaces 3*a* to 3*c* may have in particular a phosphor composition that is uniform over their area.

In the case of the reflective arrangement shown, the useful light P, S is emitted from the same side on which the primary light P is also incident. For this purpose, the carrier 2 is formed in a reflective fashion at its side facing the phosphor surfaces 3*a* to 3*c*. The carrier 2 is preferably embodied in a specularly reflective or mirroring fashion, in particular for all wavelengths present, in order that the primary radiation P passing through the phosphor surfaces 3*a*, 3*b* or 3*c* and impinging on the carrier 2 and also the secondary radiation S emitted in the direction of the carrier 2 can be effectively reflected back into the phosphor surfaces 3*a*, 3*b* or 3*c* and thus used further. This increases a conversion efficiency.

For effective dissipation of heat from the phosphor surfaces 3*a*, 3*b* and 3*c*, the carrier 2 preferably consists of metal or a sapphire-on-metal layer stack. It is also possible to arrange a dichroic layer between a nonreflective carrier 2 and the phosphor surfaces 3*a*, 3*b* and 3*c*, which dichroic layer transmits the primary light P, but reflects converted secondary light S. In this regard, a primary light proportion of the useful light P, S can be reduced. Such an arrangement is advantageous in particular for the transmissive case (here primary light must pass, whereas secondary light should be reflected for achieving a higher efficiency).

The useful light P, S emitted by the phosphor surface 3*a*, 3*b* or 3*c* impinges on a downstream secondary optical unit, which is shown here on the basis of the shell-like reflector 6. The reflector 6 may have for example a spherical, paraboloidal or freeform-shaped reflection surface, which if appropriate may be multiply faceted. The position of the illumination surface 7 and thus also the position of the respectively illuminatable phosphor surface 3*a*, 3*b* or 3*c* correspond here to a focal spot of the reflector 6. The useful light P, S is coupled out as light emission pattern L into the far field F by the secondary optical unit.

The secondary optical unit may include even further elements (not illustrated) for beam shaping of the useful light P, S, e.g. at least one lens, at least one reflector, a diaphragm or shutter, etc. This may be effected, for example, such that the reflector 6 directs the useful light P, S into a near-field intermediate plane, which can possibly also contain a shutter (not illustrated). The intermediate plane can then be imaged into the far field F (e.g. by a refractive optical unit).

By alternately introducing the differently configured phosphor surfaces 3*a* to 3*c* into the illumination surface 7, respectively associated, different light emission patterns L are generatable. The light emission patterns L may differ with regard to their shape, color and/or color distribution.

In this case, a specific light emission pattern L is generated non-sequentially. This means that a light emission pattern L is generatable completely with the carrier 2 and thus also the phosphor surfaces 3*a* to 3*c* in exactly one position (corresponding to a specific position) of the carrier 2. In order to generate a light emission pattern, therefore, the carrier 2 does not need to move two or more of the phosphor surfaces 3*a*, 3*b* or 3*c* one after another through the primary light P, rather a desired light emission pattern L is generated by illuminating exactly one of the phosphor surfaces 3*a* to 3*c*.

It is also possible to change a brightness or laser power of the primary light P by changing the position of the carrier 2. As a result, the light emission pattern L can be dimmed, e.g. in order to generate a daytime running light or a position light.

By way of example, in a first (linear) position of the carrier 2, only the phosphor surface 3*a* may be irradiated by the primary light P. As a result, e.g. a light emission pattern L may be generated which has a bluish white color and has a shape and intensity suitable for use as a daytime running light.

By a linear displacement of the carrier 2 by one position such that now only the phosphor surface 3*b* is irradiated by the primary light P, a second light emission pattern L is generated. The second light emission pattern L differs from the first light emission pattern L at least with regard to its shape and/or color, if appropriate also with regard to its brightness. In order to differentiate the color of their light emission patterns L, the phosphor surfaces 3*a* and 3*b* may have a different concentration or layer thickness of the phosphor contained therein. The second light emission pattern L may emit yellow useful light for example for use with a flashing indicator function. For this purpose, a higher proportion of blue-yellow converting phosphor may be present for example in the phosphor surface 3*a* (e.g. on account of a higher concentration and/or layer thickness).

If the carrier 2 is linearly displaced further by another position, such that now only the phosphor surface 3*c* is irradiated by the primary light P (that is to say only the phosphor surface 3*c* is situated in the illumination surface 7), a third light emission pattern L is generated, e.g. for use as a fog light or the like.

Additionally or alternatively, at least one phosphor surface can be present which generates yet another light emission pattern L, e.g. for use as a low beam, as a high beam, etc. At least two light emission patterns L may also be present for the same purpose, e.g. as daytime running light, which differ only in a light color, e.g. in a different whitish hue, for example in order to be able to react to parameters of the surroundings of the vehicle, such as rain, and/or a state of the driver, such as fatigue of the latter, e.g. in the context of an AFS or ADB.

The number of phosphor surfaces is unrestricted and may be e.g. two, three or else more than three.

The linear movement of the carrier 2 for positioning the phosphor surfaces 3*a* to 3*c* in relation to the illumination surface 7 is effected by a motor, in particular a linear motor 10. The linear motor 10 may include for example at least one electric motor (in particular stepper motor) or at least one actuator (e.g. at least one piezo-actuator with or without stroke amplification).

The linear motor 10 is coupled to a control device 11, which drives the linear motor 10. The linear motor 10 and the control device 11 may also be integrated in a single component. The control device 11 is configured to drive the linear motor 10 such that a phosphor surface 3*a*, 3*b* or 3*c* provided for a specific light emission pattern L is thereby moved linearly into the illumination surface 7. For driving the linear motor 10, the control device 11 can receive control commands ST which predefine the light emission pattern L to be generated. Said control commands ST are converted into driving signals for the linear motor 10 by the control device 11, and the driving signals are then made available to the linear motor 10 in order to predefine the linear movement thereof. The control commands ST may originate for example from a vehicle electronic unit (not illustrated). The control commands ST may be based on operating processes by a driver of the vehicle, e.g. on switching-on of a specific light function such as a high beam, and/or on an automatic selection by the vehicle. The automatic selection may be based e.g. on measurement values of at least one sensor of the vehicle. In this regard, the light emission pattern L may be changed depending on brightness, weather conditions (e.g. rain or fog), recognition of an object in front of the vehicle, the driver's attention, etc.

In principle, it is also possible to displace the carrier 2 linearly in two planar directions. In this case, in particular, the phosphor surfaces can be distributed on the carrier 2 two-dimensionally, e.g. in a matrix-shaped fashion, in a cruciform fashion, etc. By a movement of the carrier 2 in both planar directions (in the direction V and in a direction perpendicular thereto in the image plane), it is possible to move to all the different phosphor surfaces. By a two-dimensional arrangement, more phosphor surfaces can be accommodated compactly, in comparison with an only one-dimensional (e.g. strip-shaped) arrangement.

It is also possible to excite the phosphor surfaces 3*a*, 3*b* or 3*c* by a plurality of lasers 4, in particular laser diodes, or to generate the illumination surface 7 by primary light P of a plurality of lasers 4. The light thereof can pass through the same window 5 in the reflector 6, but can alternatively also pass through different windows to the phosphor surface 3*a*, 3*b* or 3*c*.

Scanning illumination may also be used instead of the stationary illumination.

Figure 2:
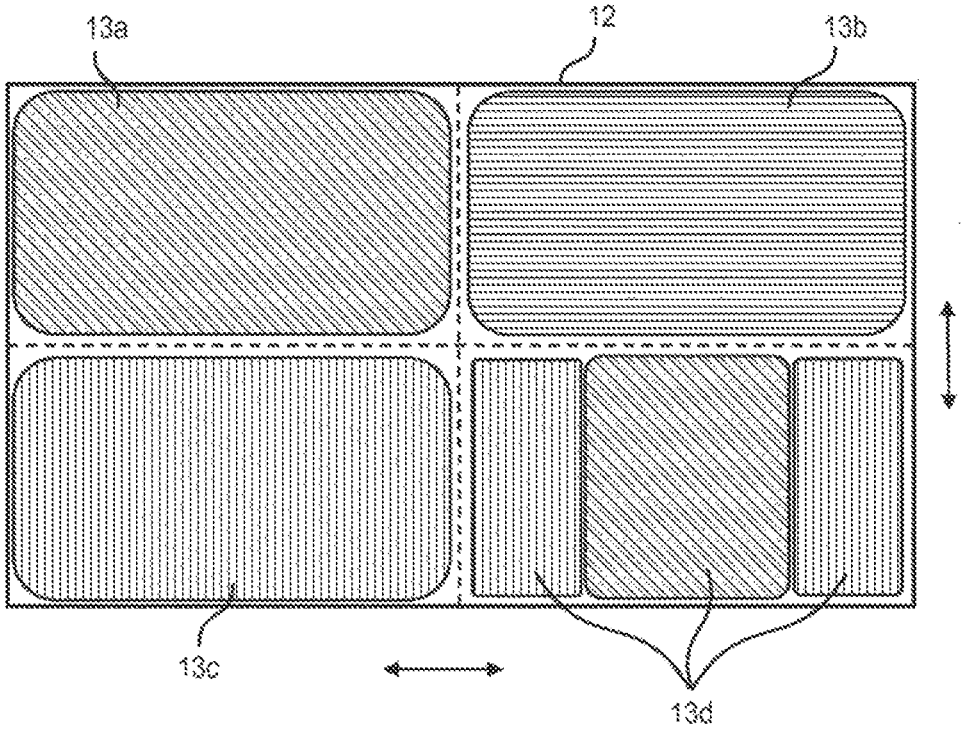
FIG. 2 shows in plan view a linearly displaceable carrier with a plurality of phosphor surfaces.

FIG. 2 shows a frontal view of a further possible carrier 12, which can be used e.g. instead of the carrier 2 in the lighting apparatus 1. The carrier 12 includes four phosphor surfaces 13*a*, 13*b*, 13*c* and 13*d* arranged alongside one another in a 2×2 matrix pattern. Only one phosphor surface 13*a*, 13*b*, 13*c* or 13*d* in each case is illuminated. Each individual phosphor surface 13*a*, 13*b*, 13*c* or 13*d* can thus generate a complete light emission pattern L. By a linear movement of the carrier 12 in its plane (e.g. generated by the linear motor 10), said carrier can be moved such that each of the phosphor surfaces 13*a*, 13*b*, 13*c* or 13*d* is in each case introducible into the illumination surface 7. The linear movement is indicated by the double-headed arrows.

The individual phosphor surfaces 13*a*, 13*b*, 13*c* or 13*d* contain different distributions of phosphors.

By way of example, the phosphor surface 13*a* may be covered homogeneously with a blue-yellow converting phosphor having a first layer thickness, in order to generate and emit a cold white light. The phosphor surface 13*b* may be covered homogeneously with a blue-yellow converting phosphor having a second layer thickness, which is thicker than the first layer thickness. As a result, a yellowish white light can be generated and emitted. A warmer hue can also be achieved by adding a blue-red converting phosphor. The phosphor surface 13*c* may be covered homogeneously with a blue-yellow converting phosphor having a third layer thickness, which is smaller than the first layer thickness. As a result, a bluish white light can be generated and emitted. The phosphor surface 13*d* may include a plurality of partial regions each covered differently homogeneously with a blue-yellow converting phosphor. In this regard, two outer regions may be covered similarly to the phosphor surface 13*c* and a central region may be covered similarly to the phosphor surface 13*a*.

However, a (2×2) pattern of the individual phosphor surfaces need not necessarily be used. Any other arbitrary division into an (n×m) pattern is thus possible, wherein n and m are integers, at least one of which is greater than one. Additionally, a length-to-width ratio or aspect ratio of the individual phosphor surfaces is freely selectable. The individual phosphor surfaces need not be rectangular, but rather can also assume other shapes. Regions that are free of phosphor can also be present between the phosphor surfaces. Moreover, an irregular arrangement of the phosphor surfaces is possible. Likewise, the arrangement of the phosphors within a phosphor surface is not limited. Any desired division can be used. Realizations are possible both in a transmissive use (transmitted-light arrangement, as shown) and in a reflective use of the phosphor.

The downstream secondary optical unit may be a reflector shell, as described, but can e.g. also be a refractive optical unit which images into the far field. Said refractive optical unit may be advantageous in particular for the transmitted-light arrangement.

The carrier 12 may be e.g. a metallic carrier for a reflective construction and e.g. a glass or sapphire carrier for a transmissive construction.

Figure 3:
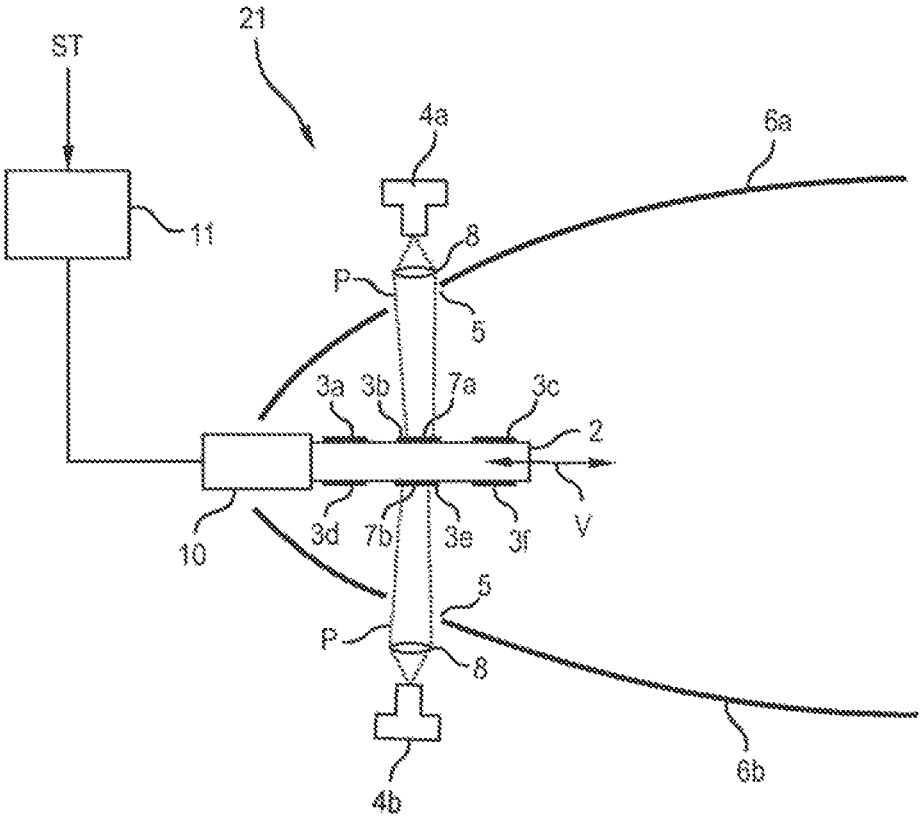
FIG. 3 shows as a sectional illustration in side view a lighting apparatus in accordance with a second embodiment.

FIG. 3 shows a lighting apparatus 21, e.g. for a vehicle headlight E, which is constructed similarly to the lighting apparatus 1. However, two reflectors 6*a* and 6*b* or corresponding reflection regions of a reflector 6*a*, 6*b* are now present. Moreover, phosphor surfaces 3*a* and 3*d*, 3*b* and 3*e*, and 3*f* and 3*c* arranged on opposite surfaces or flat sides of the carrier 2 can now be irradiated simultaneously, specifically by different lasers 4*a* and 4*b*, respectively. In other words, a first illumination surface 7*a* can be provided at a first flat side of the carrier 2 and a second illumination surface 7*b* can be provided at a second flat side of the carrier 2.

The reflectors 6*a* and 6*b* in turn are illuminated by the phosphor surfaces 3*a*, 3*b* or 3*c* and, respectively, 3*d*, 3*e* or 3*f*. A light emission pattern L in the far field F (not illustrated) can then be established by a superimposition of the useful light (not illustrated) emitted by both reflectors 6*a* and 6*b*. This corresponds to an addition of the useful light generated by opposite phosphor surfaces 3*a* and 3*d*, 3*b* and 3*e*, and 3*f* and 3*c*.

In this case, for a specific light emission pattern both lasers 6*a*, 6*b* do not need to be in operation. By way of example, a high beam may be generated by operation of both lasers 6*a*, 6*b*, whereas a low beam may be generated e.g. by operation of only one of the lasers 6*a* or 6*b*. Consequently, different light emission patterns can be made available by optionally activating the lasers 6*a* or 6*b* in an identical position of the carrier 2. Further light emission patterns can be generated by linear displacement of the carrier 2 into a different position, specifically by joint and/or respective activation of the lasers 4*a* and 4*b*.

A light color and/or shape of the light emission patterns emitted by the two reflectors 6*a* and 6*b* may be identical or different. Moreover, a light color of the primary light P emitted by the two lasers 6*a*, 6*b* may be identical or different.

Figure 4:
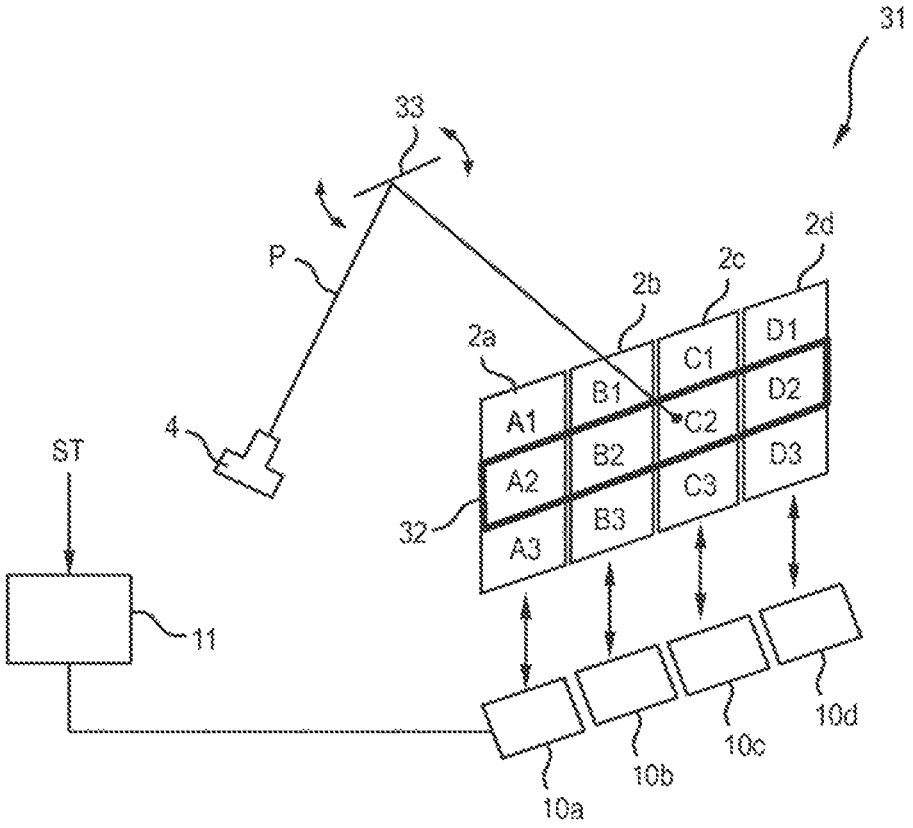
FIG. 4 shows as a sectional illustration in side view a lighting apparatus in accordance with a third embodiment.

FIG. 4 shows a lighting apparatus 31, e.g. for a vehicle headlight E, in the case of which a plurality of (here for example four perpendicularly aligned) strip-like carriers 2*a*, 2*b*, 2*c* and 2*d* each having phosphor surfaces A1 to A3, B1 to B3, C1 to C3 and D1 to D3, respectively, arranged alongside one another in a series are now present. The carriers 2*a*, 2*b*, 2*c* and 2*d* are displaceable parallel to one another along their longitudinal axes, as indicated by the double-headed arrows. The carriers 2*a* to 2*d* are arranged directly adjacently to one another (i.e. here: separated only by a practically negligibly narrow gap).

Instead of—as in the case of the lighting apparatus 1, the phosphor surfaces A2 to D2 situated in an illumination surface 32 being irradiated with the primary light P over a large area at one point in time (in a stationary fashion) and said phosphor surfaces A1 to D3 being used as quasi-light source for a downstream optical unit, the phosphor surfaces A2 to D2 situated in the illumination surface 32 are now swept over or "scanned" in a time-dependent manner ("dynamically") by a concentrated primary light beam P. For the "scanning", in particular line-like, illumination of the illumination surface 32, the primary light P may be deflectable onto the illumination surface 32 in particular via at least one movable, in particular pivotable, mirror 33, e.g. in a manner similar to that in the case of a "flying spot" method. The pivotable mirror 33 may be e.g. an MEMS component. The laser 4 may be able to be switched on and off (or dimmable) in a targeted manner. The light emission pattern thus generated may be varied by changing the illumination pattern given a fixed position or rotational position of the carriers 2*a*, 2*b*, 2*c* and 2*d*.

The illumination surface 32, which is now illuminatable by the laser 4 in a scanning manner line by line, includes a line of phosphor surfaces A1 to A3, B1 to B3, C1 to C3, and D1 to D3, arranged alongside one another transversely with respect to the displacement direction thereof, e.g. a line including the phosphor surfaces A2, B2, C2 and D2. Therefore, a phosphor surface of a strip-shaped carrier 2*a* to 2*d* is in each case illuminatable simultaneously. Since the carriers 2*a* to 2*d* are linearly displaceable independently of one another, all possible adjacent phosphor surfaces A1 to A3, B1 to B3, C1 to C3, and D1 to D3 can be combined.

The phosphor surfaces A1 to A3, B1 to B3, C1 to C3, and D1 to D3 of a respective strip-shaped carrier 2*a* to 2*d* can have in particular a different phosphor composition (e.g. with regard to a type, quantity and/or areal distribution of phosphor) and thereby generate a differently shaped and/or differently colored part of the entire light emission pattern.

A specific light emission beam pattern can be set for example by an arbitrary, but then fixedly chosen combination of the phosphor surfaces A1 to A3, B1 to B3, C1 to C3, and D1 to D3. The light generated in this case can again be projected into the far field F by an optical unit (not illustrated), in particular an imaging optical unit.

Respective linear motors 10*a* to 10*d* may be used for the linear movement of the carriers 2*a*, 2*b*, 2*c* and 2*d*, said linear motors being jointly controllable by the control device 11. Here, too, the control device 11 can receive control commands ST for driving the linear motors 10*a* to 10*d*, said control commands predefining the light emission pattern L to be generated. Said control commands ST are converted into driving signals for the linear motors 10*a* to 10*d* by the control device 11, in order to bring the combination of the phosphor surfaces A1 to D3 that is appropriate for the desired light emission pattern into the illumination surface 32.

Alternatively, instead of the scanning illumination, a stationary illumination of the phosphor surfaces A2 to D2 situated in the illumination surface 32 may be carried out, e.g. by a stationary beam of the primary light P that is of appropriate width.

In principle, the number of independently movable carriers is unrestricted and may also encompass hundreds or even thousands of independently movable carriers.

Moreover, the illuminatable region 32 can include a plurality of lines.

The lighting apparatus 31 may be implemented in a reflective arrangement or in a transmissive arrangement.

Although the invention has been more specifically illustrated and described in detail by the embodiments shown, nevertheless the invention is not restricted thereto and other variations can be derived therefrom by the person skilled in the art, without departing from the scope of protection of the invention.

In this regard, a choice may be made, in principle, between a stationary and a scanning irradiation of a phosphor surface.

Moreover, an at least one phosphor surface displaced on a curved trajectory or movement path may be used instead of or in addition to a linear translational movement.

Moreover, a rotational movement of the at least one phosphor surface may be superimposed on the translational movement, in particular in order to achieve a pivoting of the phosphor surface.

Generally, "a(n)", "one", etc. can be understood to mean a singular or a plural, in particular in the sense of "at least one" or "one or a plurality", etc., as long as this is not explicitly excluded, e.g. by the expression "exactly one", etc.

Moreover, a numerical indication can encompass exactly the indicated number and also a customary tolerance range, as long as this is not explicitly excluded.

The invention claimed is:

1. A lighting apparatus for a headlight for generating a light emission pattern in a far field, comprising:

at least one light source for emitting primary light onto an illumination surface;

the illumination surface further comprising at least two different phosphor surfaces; wherein the at least two different phosphor surfaces are at least partly alternated by at least one translational movement; and a control device for positioning the phosphor surfaces in relation to the illumination surface;

wherein respectively associated light emission pattern is configured to be generated in a predetermined position of the phosphor surfaces; and the control device is configured, for the purpose of setting a specific light emission pattern, to move at least one phosphor surface provided for this purpose into the illumination surface by at least one translational movement.

2. The lighting apparatus as claimed in claim 1, wherein the phosphor surface is movable into the illumination surface by a pure translational movement.

3. The lighting apparatus as claimed in claim 1, wherein the phosphor surface is movable into the illumination surface by a translational movement and additionally a rotational movement.

4. The lighting apparatus as claimed in claim 1, wherein the light emission patterns have a different shape, a different light color or a different color distribution.

5. The lighting apparatus as claimed in claim 3, wherein at least two light emission patterns have a differently white light color.

6. The lighting apparatus as claimed in claim 1, wherein a light emission pattern is generatable by at least one primary light beam aligned in a stationary fashion.

7. The lighting apparatus as claimed in claim 1, wherein a light emission pattern is generatable by a movement of at least one primary light beam.

8. The lighting apparatus as claimed in claim 1, wherein a plurality of phosphor surfaces are arranged fixedly on a common, at least translationally movable carrier.

9. The lighting apparatus as claimed in claim 1, further comprising a plurality of carriers which are at least translationally displaceable independently of one another and each have a plurality of phosphor surfaces, wherein a phosphor surface of a respective carrier is in each case introducible simultaneously into the illumination surface.

10. The lighting apparatus as claimed in claim 1, wherein at least one phosphor surface has a uniform distribution of phosphor.

11. The lighting apparatus as claimed in claim 1, wherein at least one phosphor surface has a nonuniform distribution of at least one phosphor.

12. The lighting apparatus as claimed in claim 11, wherein at least one phosphor surface comprises a plurality of phosphors which are distributed over the phosphor surface nonuniformly with respect to one another.

13. The lighting apparatus as claimed in claim 1, wherein the headlight is an Adaptive Frontlighting System or Adaptive Driving Beam headlight.

14. The lighting apparatus as claimed in claim 1, wherein the light emission patterns have a different shape, a different light color and a different color distribution.

* * * * *